United States Patent [19]

Sevcik et al.

[11] 4,002,190

[45] Jan. 11, 1977

[54] DEVICE FOR DEPOSITING WEFT THREAD SUPPLIES IN JET LOOMS

[75] Inventors: Zdenek Sevcik, Brno; Miroslav Bucek, Brnenske Ivanice; Jindrich Henzl, Brno, all of Czechoslovakia

[73] Assignee: Vyzkumny a vyvojovy ustav, Brno, Czechoslovakia

[22] Filed: Nov. 17, 1975

[21] Appl. No.: 632,859

[30] Foreign Application Priority Data

Nov. 15, 1974 Czechoslovakia ..... 7782/74

[52] U.S. Cl. ..... 139/452

[51] Int. Cl.[2] ..... D03D 47/36

[58] Field of Search ..... 242/47.01, 47.12, 47.13; 139/122 R, 122 H, 127 P; 226/97, 117, 118

[56] References Cited

UNITED STATES PATENTS

| | | | |
|---|---|---|---|
| 3,276,484 | 10/1966 | Bucher | 139/122 H |
| 3,916,935 | 11/1975 | Keldany | 139/122 H |

*Primary Examiner*—Henry S. Jaudon

[57] ABSTRACT

Device for depositing thread supply, particularly weft thread supply for unconventional weaving machines such as jet looms, the device being arranged between the feeding and withdrawing mechanisms for the thread. Said device has a thread inserter and at least one magazine in the shape of a body of revolution, on the circumference of which there is a system of ribs for depositing at least one thread, the said magazine and inserter being adapted for mutual relative motion.

4 Claims, 5 Drawing Figures

DEVICE FOR DEPOSITING WEFT THREAD SUPPLIES IN JET LOOMS

The present invention relates to a device for depositing thread supplies, particularly weft thread supplies in weaving looms, particularly of the jet type, in which said weft thread is withdrawn from a supply bobbin.

In textile machines, it is frequently necessary to compensate for the disproportion between a substantially constant thread feeding speed and a variable speed of withdrawing said thread. So, e.g., in an unconventional loom such as a jet weaving machine or the like, the weft thread is withdrawn at constant speed from the supply bobbin located outside the shed and periodically inserted at high speed into said shed. Usually, in those machines a device of various constructions is placed between the feeding and the withdrawing parts. A device is known, which is formed by a rotary drum or disc with a pull-out finger for the purpose of gripping the presented weft thread with a subsequent shifting thereof into the grooves about the circumference of the disc. At the beginning of the weft insertion, said finger is pushed in and the measured weft thread length is withdrawn from said disc and inserted into the shed, in jet looms, e.g., by means of an inserting nozzle.

Hitherto known devices of the above type have certain disadvantages consisting in that gripping of the thread by said finger causes increased tension, a possible consequence of which is thread breakage on the one hand, and irregular tension in the weft thread on the other hand. This results in an increased unevenness of the fabric selvedges and in an increased quantity of waste. Furthermore, the weft thread is wound onto the disc in several wrappings, which, upon withdrawal, cause a so-called balloon which on the one hand slides about the housing of the device, and on the other hand produces by centrifugal action a force opposed to the pull of the weft inserting nozzle. Therefore, the thread is withdrawn at an irregular speed which, upon weft thread insertion, may cause short picks, drags, loops, etc.

Other known devices of the types hitherto known are the so-called shaft-type measurers. In those measurers, the thread is deposited in an appropriate length in a narrow longitudinal shaft in the form of a hair pin. The weft thread thus deposited is withdrawn, upon insertion, by the weft inserting nozzle and is inserted into the shed. These devices also have certain disadvantages. The deposition of the thread into the shaft is performed either by a system of blowing nozzles, whereby more air is necessitated, or by vacuum (under pressure), in which a more expensive construction of the device is required. Furthermore, at the beginning of the weft insertion there are frequently found faulty blows by reason of the relatively large mass of the thread which must be brought into motion. Moreover, the inside of the shaft is difficult to clean because of its inaccessibility and the drawing-in of the thread is rather difficult. For the purpose of depositing long thread supplies, the depositing shafts are of considerable size.

The present invention has among its objects the mitigation of the above-described disadvantages and shortcomings. In the device according to the present invention, there is provided at least one magazine of rotary shape, on the circumference of which there is provided a system of ribs for depositing one thread, and at least one thread inserter opening towards said magazine, said magazine and inserter being adapted for mutual relative motion.

The main advantages of the device according to the present invention is above all a minimum breakage rate upon depositing the thread supply; this result is attained particularly by the evenness of tension and the imposition of a minimum resistance upon withdrawing the thread from the magazine. A further advantage consists in the low mass of the thread to be brought into motion, and in a simple drawing-in or introduction of the thread into the device, which is of simple construction and maximum reliability.

Embodiments of the present invention in the form of examples are schematically shown in the accompanying drawings, in which.

As is evident from the above, five embodiments of the device of the invention are illustrated herein, such embodiments being shown in FIGS. 1–5, respectively.

Figure 1:
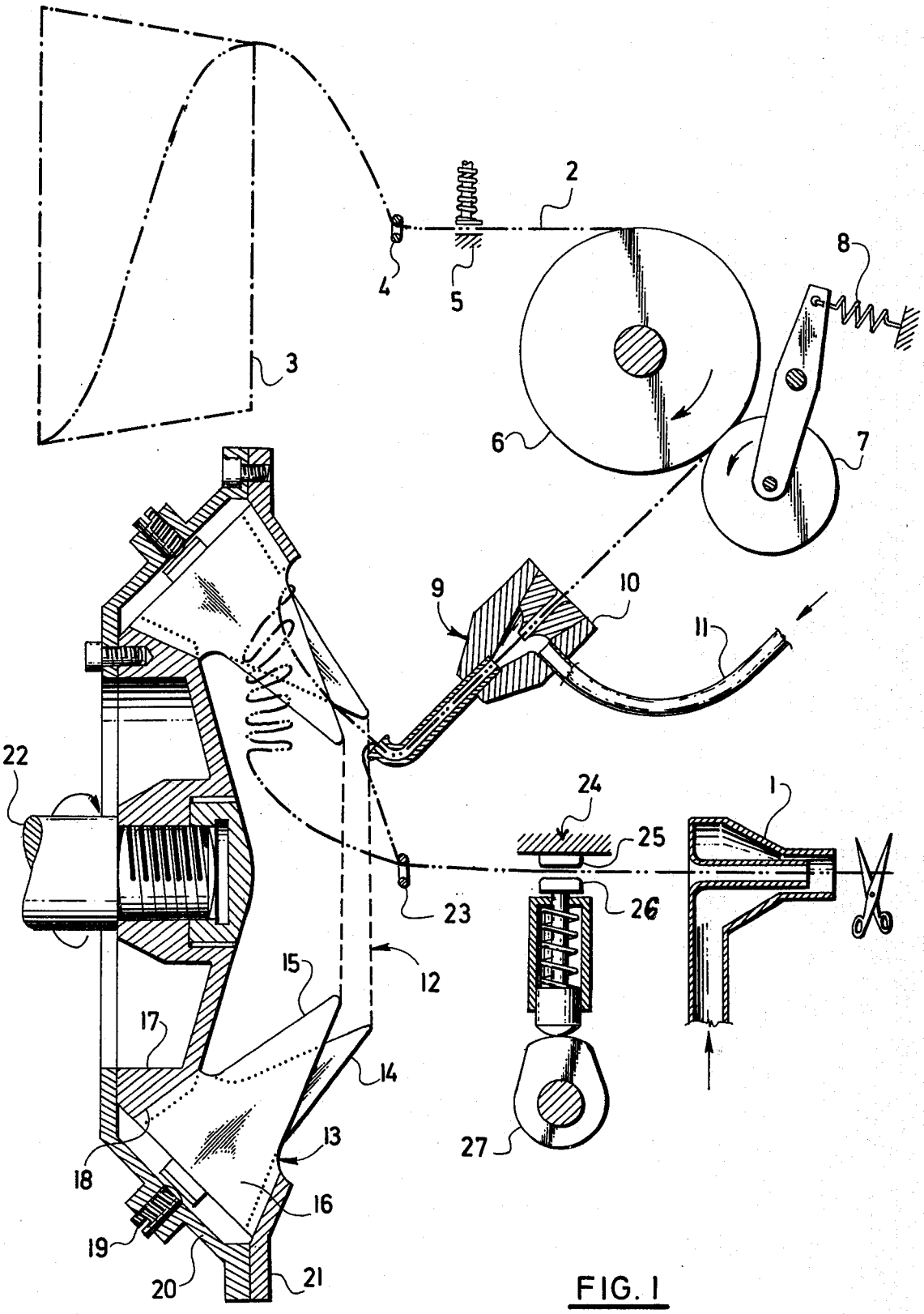
FIG. 1 is a view in longitudinal section of one exemplary embodiment of the device of the invention for depositing weft threads.

The first exemplary embodiment of the device according to the present invention is shown in FIG. 1. Such device, which is adapted for jet weaving machines, is located on the weaving machine in proximity of the weft inserting mechanism, e.g., as shown in FIG. 1, in front of the weft inserting nozzle 1. The weft thread 2 is guided from crosswound bobbin 3 via eyelet 4 and brake 5 between withdrawing rollers 6, 7, of which roll 6 is positively driven. The said rollers 6, 7 grip the weft thread 2 by the action of spring 8 and form the actual feeding mechanism for thread 2. Further, weft thread 2 is guided to the rotary magazine 12 by a stationary inserter 9 of, e.g., tubular shape. Weft thread 2 can be accelerated for increasing the efficiency of inserter 9, e.g., by pressure medium fed through a tube 11 into the body 10 of the inserter 9. The said inserter 9 of weft thread 2 and magazine 12 for weft thread 2 are adapted for mutual relative motion.

Figure 2:
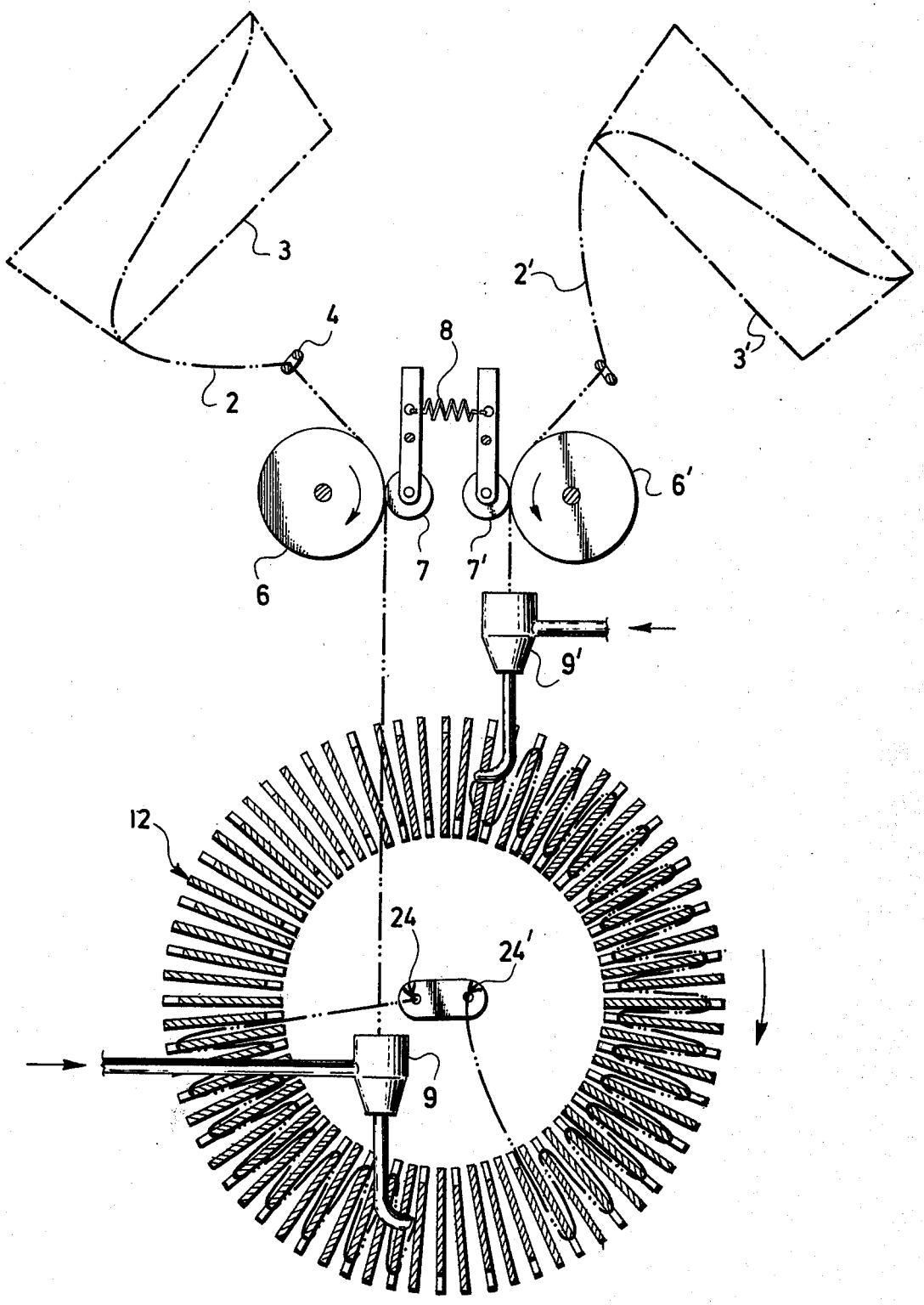
FIG. 2 is a view in front elevation of another exemplary embodiment of the device according to the present invention.

In the exemplary embodiments of FIGS. 1–4, inclusive, the magazine 12 for the weft thread 2 has the shape of a body of revolution and is rotatably mounted. In the embodiment of FIG. 2, the magazine 12 is provided about its circumference with a system of ribs 13, between which the weft thread 2 is fed by inserter 9 and is deposited therein. The ribs 13 of magazine 12 for depositing weft thread 2 may be formed in various manners. In FIGS. 1, 2, 3 and 5, said ribs are formed of blades 14, 15 of substantially triangular shape. Said blades are arranged on body 17 of magazine 12, e.g., with their bases 16, in grooves 18 and fixed by means of screws 19 and lid 20 to rim 21. The vertices of successive triangles are staggered relative to the bases thereof, a rotary groove of V-shape thus being formed therebetween about the circumference of the magazine.

The magazine 12 is mounted on a driven rotatable shaft 22 which is driven similar to rollers 6, 7, derived from a further, main shaft (not shown) of the machine. Weft thread 2 is guided from magazine 12 through an eyelet 23 and thence between jaws 25, 26 of a brake 24; the jaws alternately grip and release said thread relative to the appurtenant weaving process phase. One jaw 25 is stationary, the other jaw 26 being displaceable and resiliently engageable with a driving cam 24 therefor. Beyond jaws 25, 26, weft thread 2 is introduced into an inserting nozzle 1 directed into a weaving shed (not shown). All elements mentioned above form the circuit of weft thread 2.

Upon operation of the weaving machine, the device operates in such manner that the weft thread 2 is withdrawn by positively driven rollers 6, 7 from crosswound bobbin 3 and fed into inserter 9, which deposits weft thread 2 into the relatively narrow gaps (see FIG. 2) between ribs 13 of the rotating magazine 12. Weft thread 2 is deposited and forms tight loops while being bent around the edges of the ribs or blades 14, 15 (see FIGS. 1 and 2). This tight embracement of the blades or ribs 14, 15 by the thread 2 causes sufficient frictional contact to retain the thread 2 on the blades or ribs 14, 15 before the thread is removed for picking. The degree of inclination of the ribs 14, 15 is variable as can be noted by comparing FIGS. 1 and 2. At the beginning of the inserting phase, the grip of jaws 25, 26 is released. The inserting nozzle 1 ejects weft thread 2 into the shed. By closing jaws 25, 26, the insertion of weft thread 2 is finished for the described cycle or phase of the weaving process. Weft thread 2 is again deposited into the magazine 12 in starting the next cycle, and the above steps are then repeated.

The device according to the present invention may be used for feeding a plurality of weft threads, suitable, e.g., for a pick change. In FIG. 2 such an alternative embodiment is shown; in such embodiment, each weft thread 2 and 2' has its own pair of positively driven rollers 6, 7 and 6', 7' and its own inserter 9 and 9', the latter having the circumference of the common magazine 12 divided between them and thus feeding weft threads 2, 2' into the respective parts of the magazine 12, which are alternatively filled and emptied during weaving. The respective weft thread 2, 2' is thereupon withdrawn through the respective eyelet 23 or 23' to brakes 24, 24' and therefrom into their respective nozzles (not shown).

Figure 3:
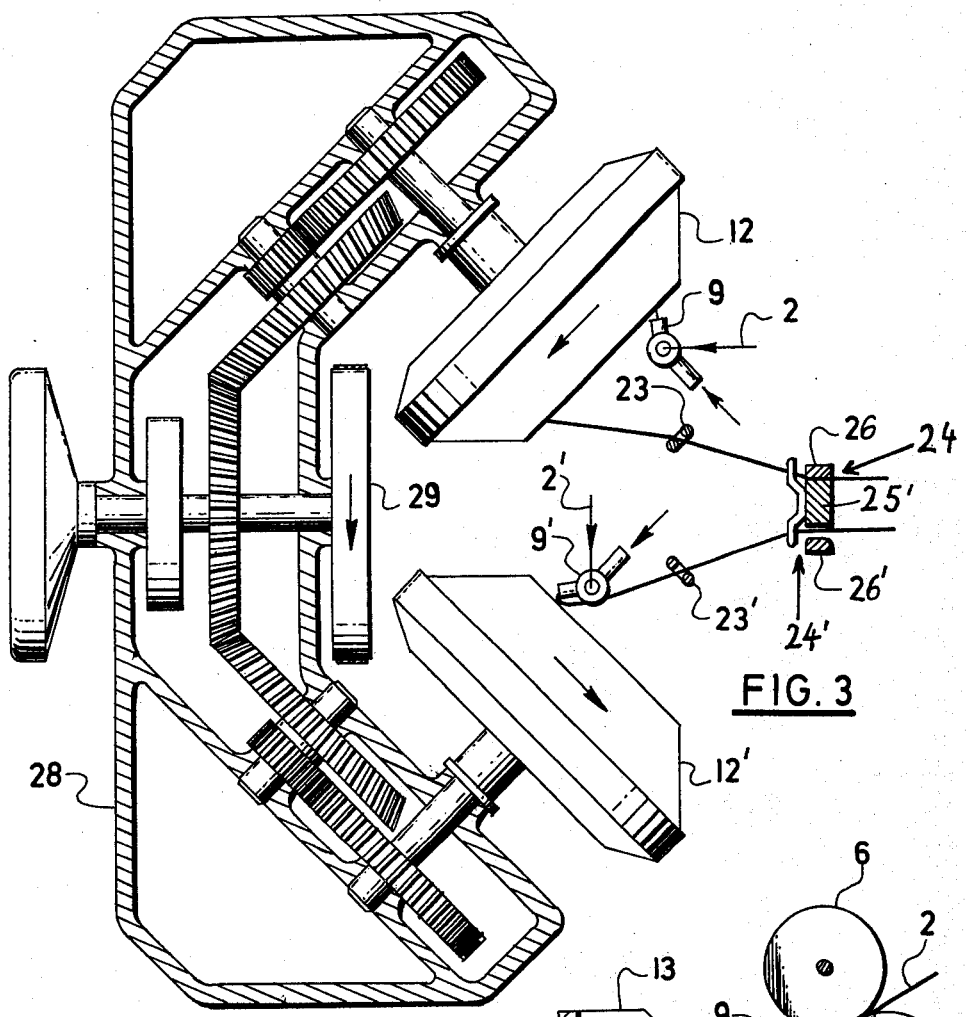
FIG. 3 is a view in plan of a further exemplary embodiment of the device according to the present invention.
Figure 4:
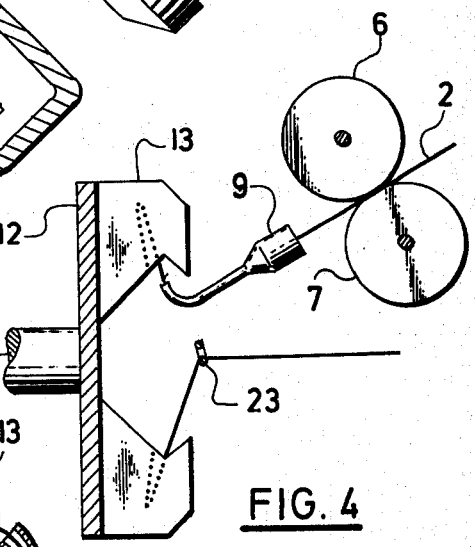
FIG. 4 is a view in longitudinal section of another exemplary embodiment of the device according to the present invention.

The same problem is solved in another manner by the embodiment of the device according to the present invention as shown in FIG. 3. The device as shown in this figure differs from those already specified only in that inside a frame 28 there are mounted together with a common drive 29 two magazines 12, 12' for depositing weft threads 2 and 2', respectively, said magazines being continuously filled with weft thread 2 and 2', one of them being emptied while the other is being filled, and vice-versa. The device of FIG. 3 is provided with two brakes 24 and 24' which cooperate with the respective threads 2, 2'. Brake 24 is formed by a central fixed jaw 25' and a reciprocable jaw 26, whereas brake 24' is formed by fixed jaw 25' and a reciprocable jaw 26'.

The embodiments of the present invention shown in FIGS. 1, 2 and 3 and described above are illustrative only. For the purpose of simplifying the manufacture of magazine 12, ribs 13 may also be formed in a simpler manner, as shown in the exemplary embodiment in FIG. 4. Ribs 13 have here the same flat shape and are radially arranged in view of the axis of magazine 12 and provided for the purpose of improved guiding of weft thread 2 with a recess.

Figure 5:
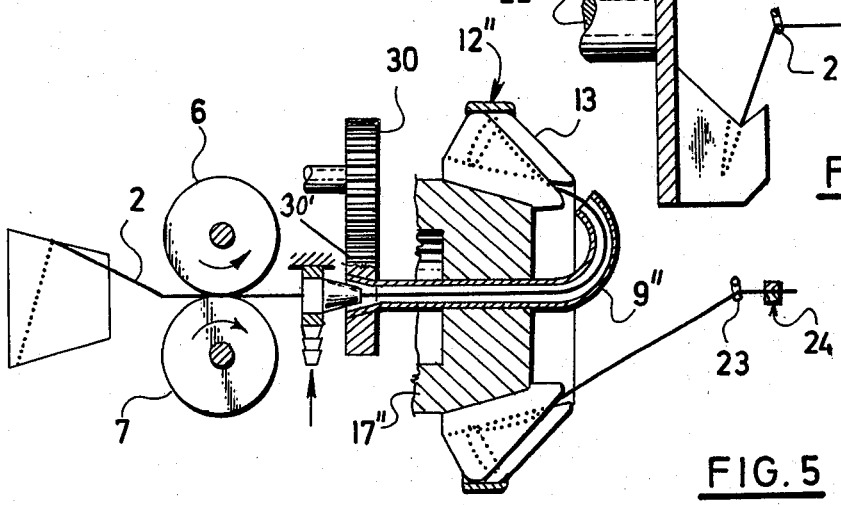
FIG. 5 is a view in longitudinal section of a still further exemplary embodiment of the device according to the present invention.

The device according to the present invention may also be made in such manner (FIG. 5), wherein magazine 12'' is stationary and inserter 9'' is rotated. The weft thread 2, similar to the other embodiments, is withdrawn by withdrawing rollers 6, 7. Magazine 12'' is mounted stationarily on the weaving machine, and, as described, inserter 9'' is rotatably driven. In the embodiment of FIG. 5, a tube-shaped inserter 9'' is mounted rotatably on the axis of body 17'' of magazine 12'' and its bent end opens towards ribs 13 of the magazine 12''. Inserter 9'' is rotatably driven via a gear drive 30, 30' from the main shaft (not shown) of the machine. For the purpose of increasing efficiency, gas pressure medium is transferred into inserter 9''. The device operates upon weaving in the same manner as the embodiments of the present invention already described above.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

What is claimed is:

1. A device for depositing weft thread supply for weaving machines having feeding and withdrawing mechanisms for the thread, said device being arranged between the feeding and withdrawing means and comprising an inserter, a magazine in the shape of a body of revolution, a plurality of uniformly arranged ribs projecting towards the axis of said body of revolution and being mounted thereon, said ribs defining gaps therebetween, said inserter being adapted to deposit said thread in said magazine so as to extend across opposite edges of said ribs and into said gaps between adjacent ribs and means for relatively rotatably driving the said magazine and inserter.

2. A device as claimed in claim 1, wherein the ribs of the magazine have a flat face and are radially arranged relative to the axis of the magazine.

3. A device as claimed in claim 2, wherein the ribs of the magazine are formed by blades of substantially triangular shape, said blades being arranged with their bases about the circumference of the magazine, the vertices of successive blades being mutually staggered.

4. A device as claimed in claim 1, wherein the inserter is of tubular shape and is provided with a supply of fluid pressure medium to accelerate the inserted thread.

* * * * *